US006536783B2

(12) United States Patent
Gorza et al.

(10) Patent No.: US 6,536,783 B2
(45) Date of Patent: Mar. 25, 2003

(54) BRAKING DEVICE PARTICULARLY FOR SKATES

(75) Inventors: Roberto Gorza, Feltre (IT); Nicola Vendramin, Piombino Dese (IT)

(73) Assignee: Benetton Group S.p.A., Ponzano Veneto (IT)

( * ) Notice: Subject to any disclaimer, the term of this patent is extended or adjusted under 35 U.S.C. 154(b) by 0 days.

(21) Appl. No.: 10/178,245

(22) Filed: Jun. 25, 2002

(65) Prior Publication Data

US 2002/0158427 A1 Oct. 31, 2002

Related U.S. Application Data

(62) Division of application No. 09/453,098, filed on Dec. 2, 1999, now Pat. No. 6,425,586.

(30) Foreign Application Priority Data

Dec. 30, 1998 (IT) ..... TV98A0167
Mar. 24, 1999 (IT) ..... TV990016 U

(51) Int. Cl.[7] ..... A63C 17/14

(52) U.S. Cl. ..... 280/11.204; 280/11.207; 280/11.211; 280/11.215; 188/5

(58) Field of Search ..... 280/11.204, 11.205, 280/11.206, 11.207, 11.208, 11.209, 11.211, 11.212, 11.213, 11.214, 11.215, 11.216, 11.217; 188/5

(56) References Cited

U.S. PATENT DOCUMENTS

| | | | | |
|---|---|---|---|---|
| 4,275,895 A | | 6/1981 | Edwards | 280/11.211 |
| 4,298,209 A | | 11/1981 | Peters | 280/11.211 |
| 4,553,767 A | | 11/1985 | Robjent et al. | 280/11.211 |
| 5,415,419 A | | 5/1995 | Bourque | |
| 5,435,579 A | | 7/1995 | Pozzobon | |
| 5,486,011 A | | 1/1996 | Nelson | 280/11.211 |
| 5,486,012 A | | 1/1996 | Olivieri | |
| 5,505,469 A | | 4/1996 | Zorzi et al. | |
| 5,511,804 A | | 4/1996 | Pellegrini, Jr. et al. | |
| 5,590,889 A | | 1/1997 | Pozzobon | |
| 5,653,454 A | | 8/1997 | Chin | |
| 5,735,537 A | | 4/1998 | Zorzi | 280/11.211 |
| 5,769,433 A | | 6/1998 | Edauw et al. | |
| 5,865,445 A | | 2/1999 | Svensson et al. | 280/11.211 |
| 5,868,404 A | * | 2/1999 | Montague | 280/11.213 |
| 5,895,061 A | | 4/1999 | Gignoux | 280/11.211 |
| 5,938,213 A | | 8/1999 | Gignoux | 280/11.211 |
| 5,984,323 A | * | 11/1999 | Daley | 280/11.204 |
| 5,992,862 A | * | 11/1999 | Mitchell | 188/5 |
| 6,007,076 A | | 12/1999 | Zorzi et al. | 280/11.211 |
| 6,010,136 A | | 1/2000 | Hoskin | 280/11.211 |
| 6,039,330 A | | 3/2000 | Hoskin | 280/11.211 |
| 6,065,761 A | | 5/2000 | Gignoux et al. | 280/11.211 |
| 6,131,920 A | | 10/2000 | Roman et al. | |
| 6,283,481 B1 | * | 9/2001 | Roman et al. | 280/11.214 |
| 6,412,792 B1 | * | 7/2002 | Hoskin | 280/11.204 |
| 2002/0067010 A1 | * | 6/2002 | Gorza et al. | 280/11.201 |

* cited by examiner

*Primary Examiner*—Brian L. Johnson
*Assistant Examiner*—J. Allen Shriver
(74) *Attorney, Agent, or Firm*—Guido Modiano; Albert Josif; Daniel O'Byrne

(57) ABSTRACT

A braking device, particularly usable for skates comprising a shoe composed of a quarter which is articulated to a shell associated with a supporting frame for two or more wheels, and comprising at least one traction element which is connected at one end to a tab which protrudes from a braking element which is located in a region which is adjacent to the last wheel and oscillates in contrast with at least one flexible element. In the braking device, the traction element is associated, at its other end, with two levers which operatively interact with the quarter and allow to take up the traction element when the quarter oscillates backward so as to place the braking element in contact with a braking surface.

13 Claims, 6 Drawing Sheets

BRAKING DEVICE PARTICULARLY FOR SKATES

CROSS-REFERENCE TO RELATED APPLICATIONS

This application is a divisional of application Ser. No. 09/453,098, filed on Dec. 2, 1999 now U.S. Pat. No. 6,425,586.

BACKGROUND OF THE INVENTION

The present invention relates to a braking device particularly usable for skates which comprise a shoe composed of a quarter which is articulated to a shell which is in turn associated with a supporting frame for two or more wheels.

Currently, in conventional roller skates, whether constituted by a shoe associated with a support for two pairs of mutually parallel wheels or by a shoe associated with a supporting frame for two or more in-line wheels, the problem is felt of braking the wheels in order to be able to adjust the speed of the skate.

Accordingly, it is known to use pads or blocks, usually made of rubber, which are arranged at the tip or heel region of the shoe. When the skater tilts the shoe forwards or backwards, the free end of the pads or blocks interacts with the ground and braking is accordingly achieved.

However, these solutions have some drawbacks, since the user has to rotate the shoe, and therefore the frame associated therewith, at the tip or heel, and this can cause loss of balance and consequent falls.

U.S. Pat. No. 1,402,010 discloses a roller skate provided with a strap which can be fastened on the user's leg above the malleolar region, a rod being connected to the strap. The rod wraps around the leg in the rear region and is then curved so as to laterally affect the leg until it is associated, at its ends in the malleolar region, with a lever system which is articulated to a structure which protrudes from the wheel, supporting frame. Said lever system protrudes to the rear of the frame and is connected to a plate which is shaped approximately complementarily to the curvature of part of an underlying and facing wheel.

This solution is not free from drawbacks: first of all, a relative motion is produced between the strap and the leg throughout sports practice, and this makes it uncomfortable to use due to the continuous friction of the strap against the leg.

Additionally, the plate is actuated whenever the user bends his/her leg backwards beyond a given angle and there is no practical and easy way to alter this condition.

Moreover, each user has a specific leg shape and therefore braking is achieved at different rotation angles, given an equal length of the rod.

Moreover, said rod acts and presses in the malleolar region and this can cause discomfort or lead to accidental impacts.

U.S. Pat. No. 4,275,895 discloses a brake for skates having two pairs of mutually parallel wheels which acts at the rear wheels.

Said brake is constituted by a flap which is associated with the shoe in the rear region; a blade is associated with said flap in a rear region and is pivoted at the shoe supporting frame.

Said blade has, at its free end, a transverse element on which two C-shaped elements are formed at the lateral ends; following a backward rotation applied to the flap, said C-shaped elements interact with the rear wheels that face them, in that they interact with their rolling surface.

However, also this solution has drawbacks: it is in fact structurally complicated and is therefore difficult to industrialize; moreover, adapted springs are necessary to reposition the flap in the condition in which the C-shaped elements do not interact with the wheels, and this further increases structural complexity.

Moreover, the structural configuration of the brake causes the pair of C-shaped elements to interact with the wheel even in case of a minimal backward rotation applied to the flap and therefore even in case of involuntary movements; this causes unintended braking and therefore possible loss of balance and lack of coordination.

U.S. Pat. No. 4,300,781 discloses a braking device for skates comprising mutually parallel wheel pairs.

Accordingly, it comprises a brake which is constituted by a blade which is transversely pivoted at the rear end of the frame for supporting a shoe; pads are associated with the ends of said blade and face the rolling surface of the pair of rear wheels.

The brake is actuated by using a cable which is adapted to rotate the blade, in contrast with a spring associated with the support for the pair of front wheels, so as to place the pads in contact with the rolling surface of the pair of rear wheels.

Said cable can be actuated by means of rings or handles which are associated with a band arranged on the legs of the user by way of the presence of temporary connection means.

However, this solution has considerable drawbacks: first of all, actuation of the brake may cause loss of balance during sports practice, since the user does not assume, with his/her body, a position which is adapted to control the sudden speed reduction, because only the skater's hand is involved in the actuation of the brake.

Moreover, if the user is wearing pants or trousers, when the rings are pulled the band may slide on the pants or make them slide along the leg, hindering the braking action.

Moreover, there is a loose cable which in addition to being a hindrance to the skater can accidentally catch during speed skating, especially since coordination of the arm-leg movement causes said legs to move rhythmically and laterally outwards.

U.S. Ser. No. 09/351,004 filed Jul. 20, 1999 discloses a braking device particularly for skates which comprise a shoe composed of a quarter which is articulated to a shell which is associated with a supporting frame for two or more wheels, comprising a soft strap which connects the quarter to a braking element which is freely pivoted to said frame at the pivoting axis of the last wheel. The strap is associated with the quarter at a first end, is then guided on a means which is fixed to the shell, made to slide thereon and/or on the surface of an innerboot, and is connected, at a second end, to a tab which protrudes from the braking element in a region that lies above the last wheel; the braking element oscillates in contrast with at least one flexible element.

Also this solution has drawbacks, since the path of the soft strap has many bends which cause the overall efficiency of the device to be very low; the presence of said bends in fact entails the dissipation, in the form of friction, of most of the force applied by the user to the quarter.

SUMMARY OF THE INVENTION

The aim of the present invention is to eliminate the drawbacks noted above in conventional devices by providing a braking device for skates which is highly efficient from the functional point of view, structurally very simple and easy to industrialize and at the same time allows complete freedom of forward motion of the quarter.

An important object of the present invention is to provide a braking device which is highly effective in transmitting forces from the quarter to the braking element and also has limited rearward dimensions, accordingly allowing optimum attention to the overall aesthetic styling of the skate.

Another object of the present invention is to provide a device which the user can actuate when really necessary and therefore not accidentally.

Another important object of the present invention is to provide a braking device which can be actuated rapidly, simply and safely by the user without said user having to perform movements, for example with his hands, which compromise his balance or coordination.

Another object of the present invention is to provide a device which associates with the preceding characteristics that of being reliable and safe in use, has low manufacturing costs, and can also be applied to conventional skates.

This aim, these objects and others which will become apparent hereinafter are achieved by a braking device, particularly for skates comprising a shoe composed of a quarter which is articulated to a shell associated with a supporting frame for two or more wheels, and comprising at least one traction element which is connected at one end to a tab which protrudes from a braking element which is located in a region which is adjacent to a last wheel and oscillates in contrast with at least one flexible element, characterized in that said at least one traction element is associated, at its other end, with at least one lever articulated to said shell and slidingly associated with said quarter, said at least one lever being adapted to take up said traction element when said quarter oscillates backwards so as to actuate said braking element.

BRIEF DESCRIPTION OF THE DRAWINGS

Further characteristics and advantages of the present invention will become apparent from the following detailed description of a particular embodiment thereof, illustrated only by way of non-limitative example in the accompanying drawings, wherein.

DESCRIPTION OF THE PREFERRED EMBODIMENTS

Figure 1:
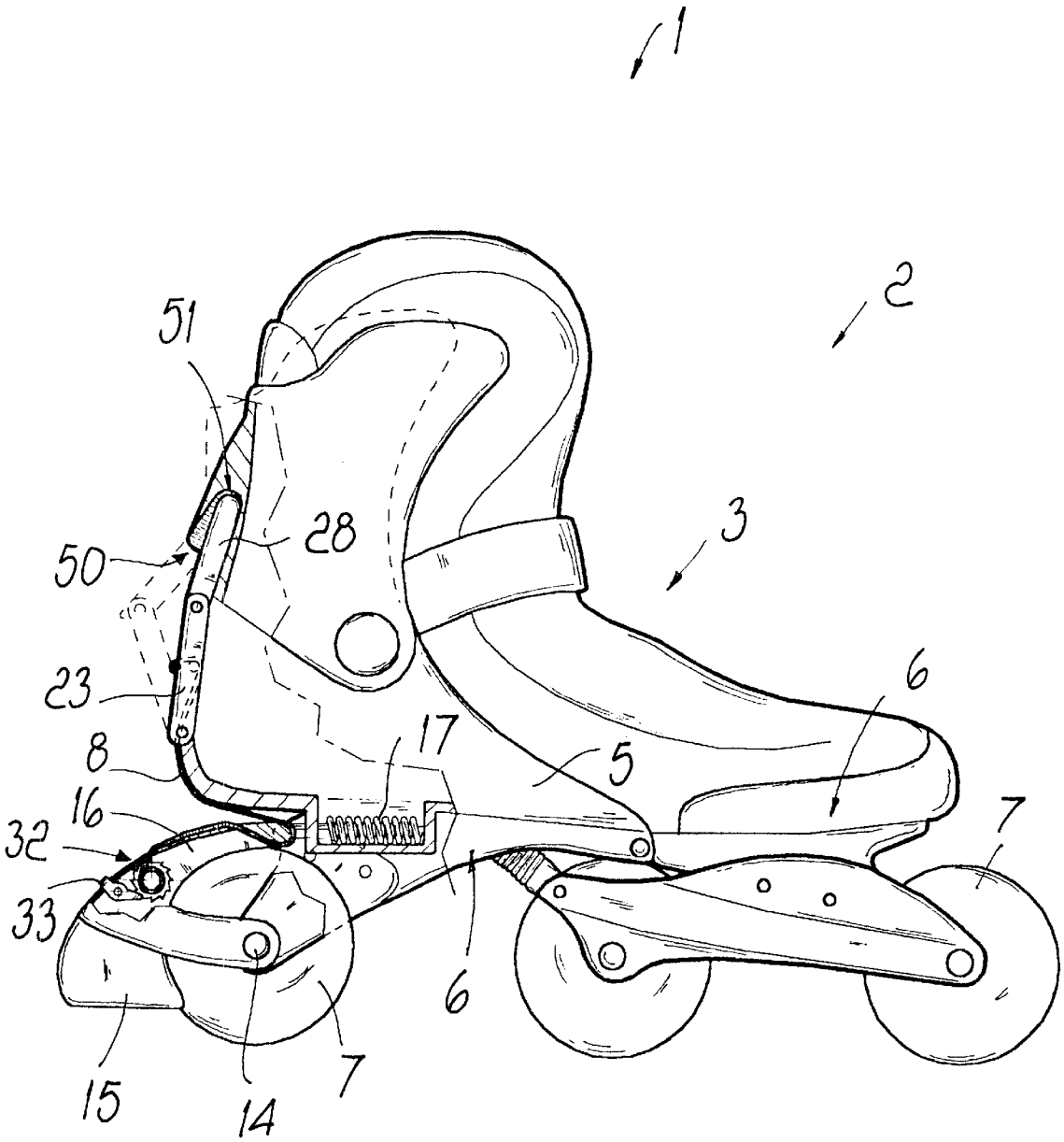
FIG. 1 is a partially sectional side view of the braking device associated with the skate.
Figure 2:
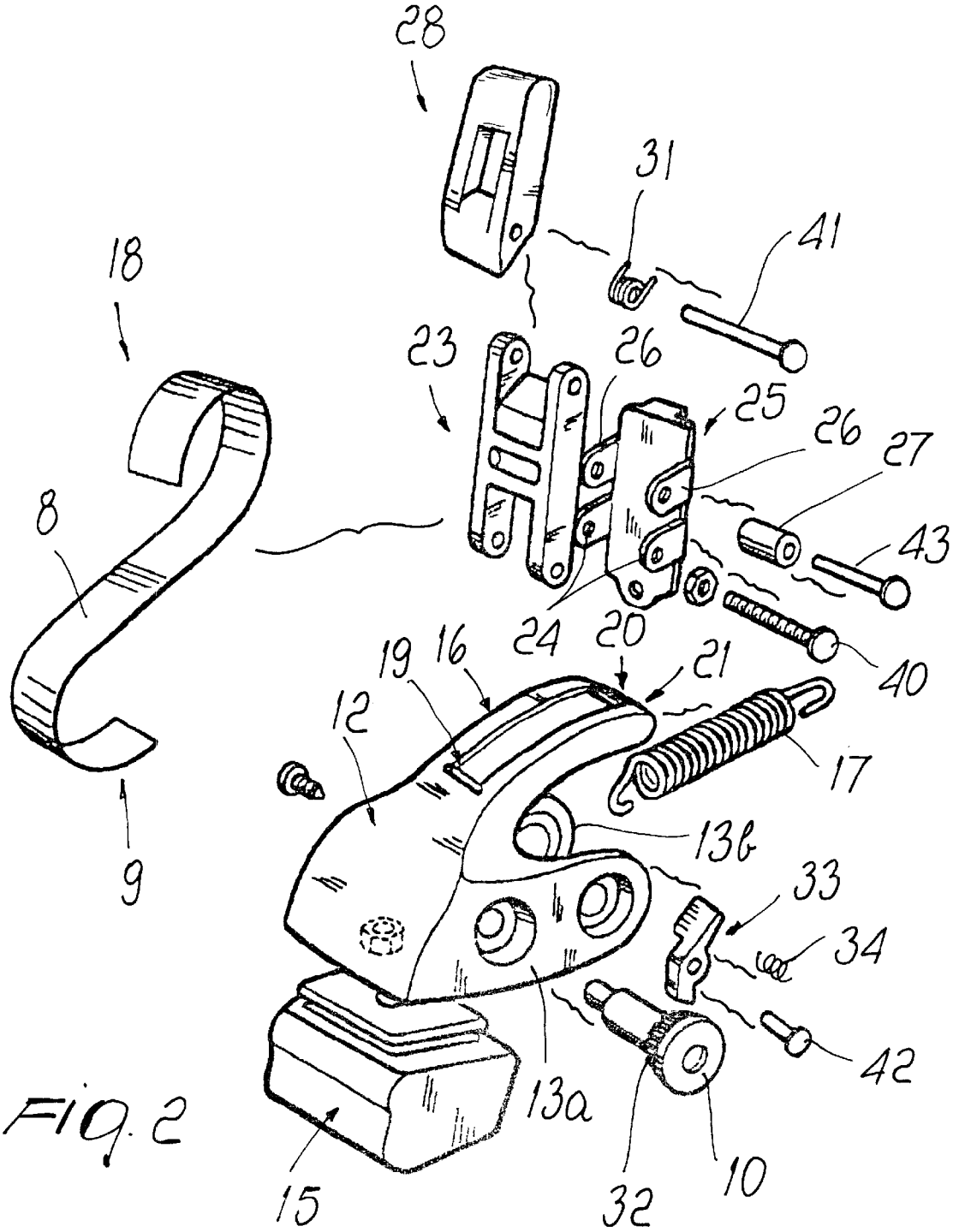
FIG. 2 is an exploded view of the components of the braking device.
Figure 3:
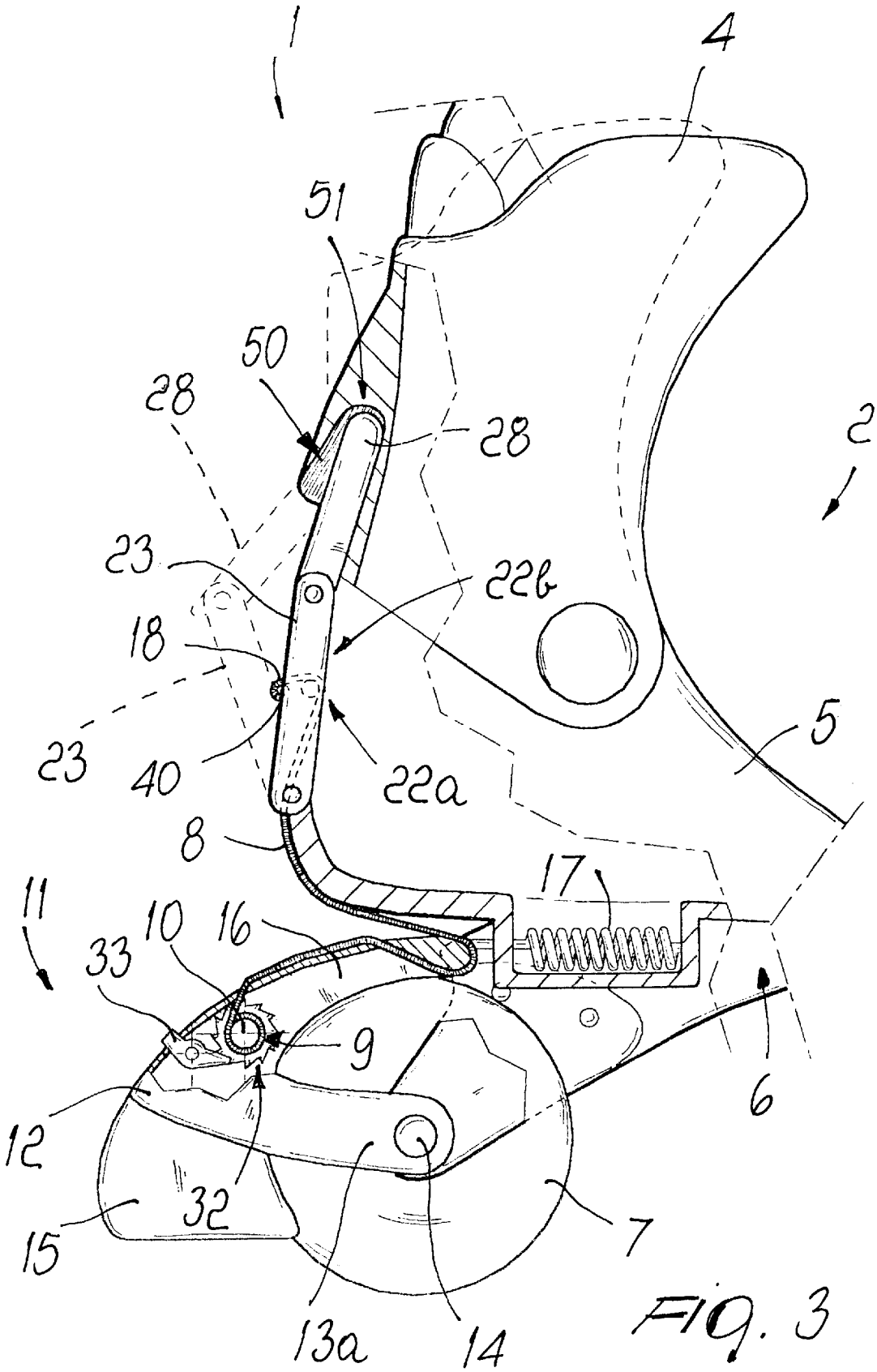
FIG. 3 is another partially sectional side view of a further embodiment of the braking device.

With reference to FIGS. 1–3, the reference numeral 1 designates the braking device, which is particularly usable for skates designated by the reference numeral 2.

Said skates comprise a shoe 3 composed of a quarter 4 which wraps around the lateral and rear region of the leg of the user and is articulated to a shell 5 below which a frame 6 is associated; said frame has a cross-section shaped like an inverted U and supports two or more wheels, designated by the reference numeral 7, which are optionally arranged mutually in-line.

Conventional levers, not shown, fasten the quarter 4 and the shell 5, and a soft innerboot, also not shown, is contained in the quarter 4 and/or the shell 5, as known to the person skilled in the art.

The braking device comprises at least one traction element, generally designated by the reference numeral 8, which is preferably constituted by a band or a cable.

Said traction element has a first end 9 which is associated with a braking element 11 constituted by a substantially C-shaped support 12 whose first wings 13*a* and 13*b* are advantageously pivoted at a second pivot 14 for the pivoting of the last wheel 7; a pad 15 is associated with said support 12 and interacts with a braking surface which is constituted for example by the ground or by one or more regions of one or more wheels; a tab 16 protrudes toward said frame and lies above the last wheel.

The braking element 11 is allowed to oscillate in contrast with a flexible element such as a first spring 17 which is rigidly coupled, at its ends, at the end of said tab 16 and to the frame 6 or shell 5.

Advantageously, the first end 9 of the traction element is associated at a first adjustment pivot 10 which is rotatably associated at an adapted seat formed in the braking element 11; the first pivot 10 allows to adjust the useful length of the traction element 8.

The traction element 8 protrudes outside the tab 16 through a first slot 19 formed thereon; the band is then passed through a second slot 20 below the tab, then affects the tip 21 of the tab, and then affects the outer lateral surface of the shell; the band is then made to enter and exit the shell, preferably at third mutually adjacent openings 22*a* and 22*b* provided in a region which is proximate to the heel of the user.

As an alternative, exit from the shell can occur at the upper perimetric edge of said shell.

The traction element 8 further has a second end 18 which is associated with a third pivot 40 which is in turn rigidly coupled in a median region of a first lever or linkage 23, which is freely pivoted, at one end, to a pair of mutually parallel second wings 24 which protrude downwards from a first base 25 which is rigidly coupled to the rear of the shell 5; advantageously, said base has, in an upward region, a pair of third wings 26 between which a guiding roller 27 for the band 8 is freely rotatably associated by means of a sixth pivot 43; accordingly, there is no need to make said band enter and exit the shell.

The first lever 23 is articulated at its other end, by means of a fourth pivot 41, to the corresponding end of a second lever 28 which is in turn freely slidingly associated at an adapted seat 50 which is formed to the rear and axially with respect to the quarter 4 and has an abutment surface 51.

The end part of the second lever is freely slideable within the seat 50, and the depth and shape of said seat are the most appropriate according to the various stages that can occur during skating and therefore said seat partially contains the second lever when the quarter reaches its maximum forward inclination and allows to avoid jamming once said quarter has been tilted backwards.

A second spring 31 is arranged coaxially to the fourth pivot 41 and is adapted to force the arrangement of the first and second levers or linkages adjacent to the shell 5.

As already noted, the braking device can further tension or adjust the length of the band by providing, on the head of the first adjustment pivot 10, a toothed ring 32 which interacts with a ratchet 33 which is pivoted outside the support 12 by means of a fifth pivot 42.

A third spring 34 forces the ratchet into contact with the toothed ring so as to prevent its rotation following a partial winding of the band on the first pivot 10.

This adjustment is deactivated simply by acting on the end of the ratchet that does not interact with the toothed ring.

Use of the invention is as follows: during sports activity, and therefore if the quarter is tilted forwards, the traction element 8 is not subjected to any tensioning, the second lever being free to slide within the seat 50 and therefore not hindering the forward oscillation of said quarter.

When instead the user tilts the quarter backwards beyond a preset angle, the first and second levers tend to move away from the shell 5 due to the pressure applied by the abutment surface 51 to the second lever 28, accordingly moving, by means of the third pivot 40, also the second end 18 of the traction element 8 and applying tension to it.

The braking pad 15 is thus forced into contact with the braking surface, for example the ground.

When it is no longer necessary to perform braking, the return of the quarter to an upright position places the first and second levers adjacent to the shell 5 and the presence of the first spring 17 allows the movement of the pad 15 away from the braking surface, which in this embodiment is constituted by the ground.

Figure 4:
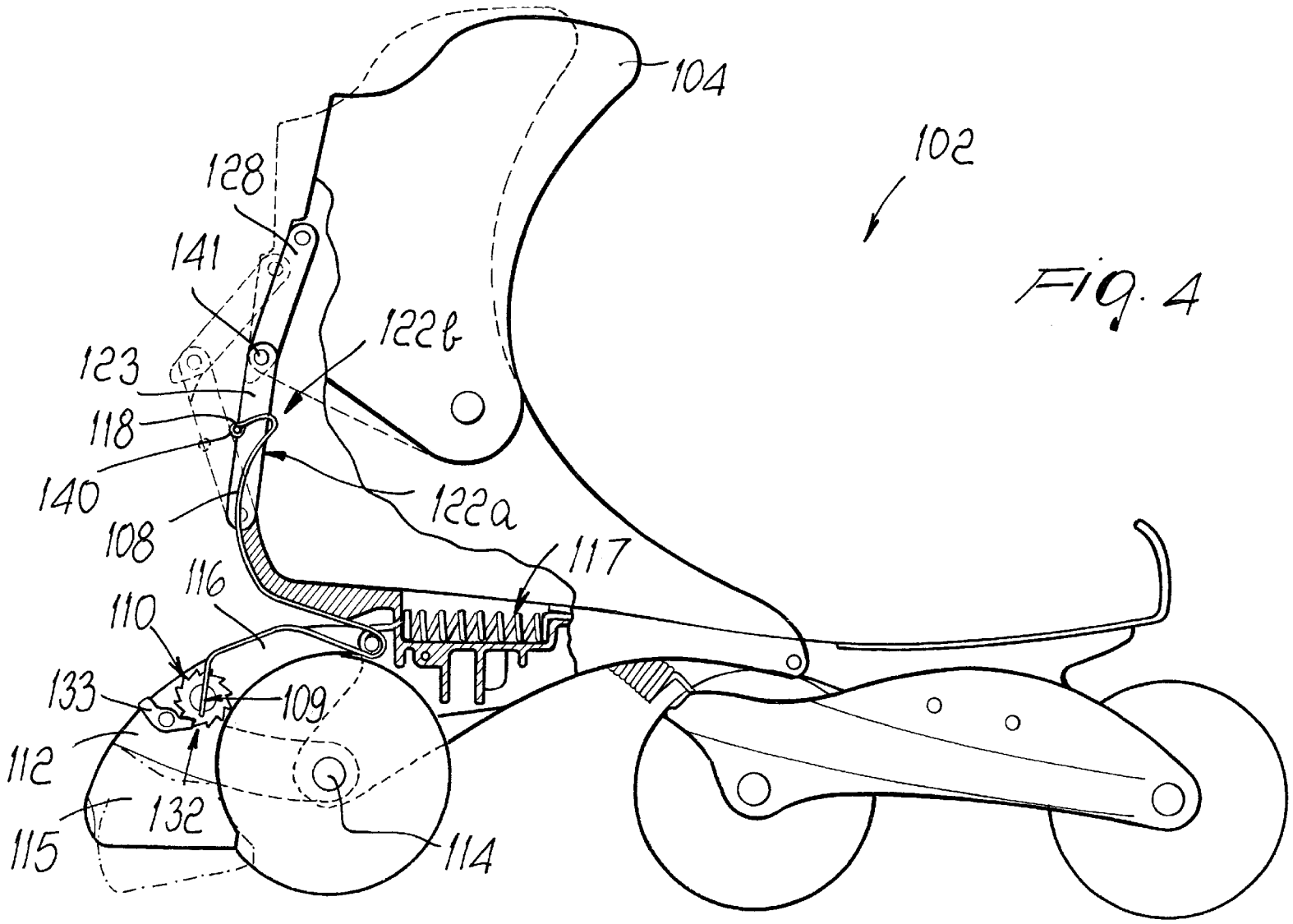
FIG. 4 is a partially sectioned side view of the braking device according to a further aspect of the invention.
Figure 5:
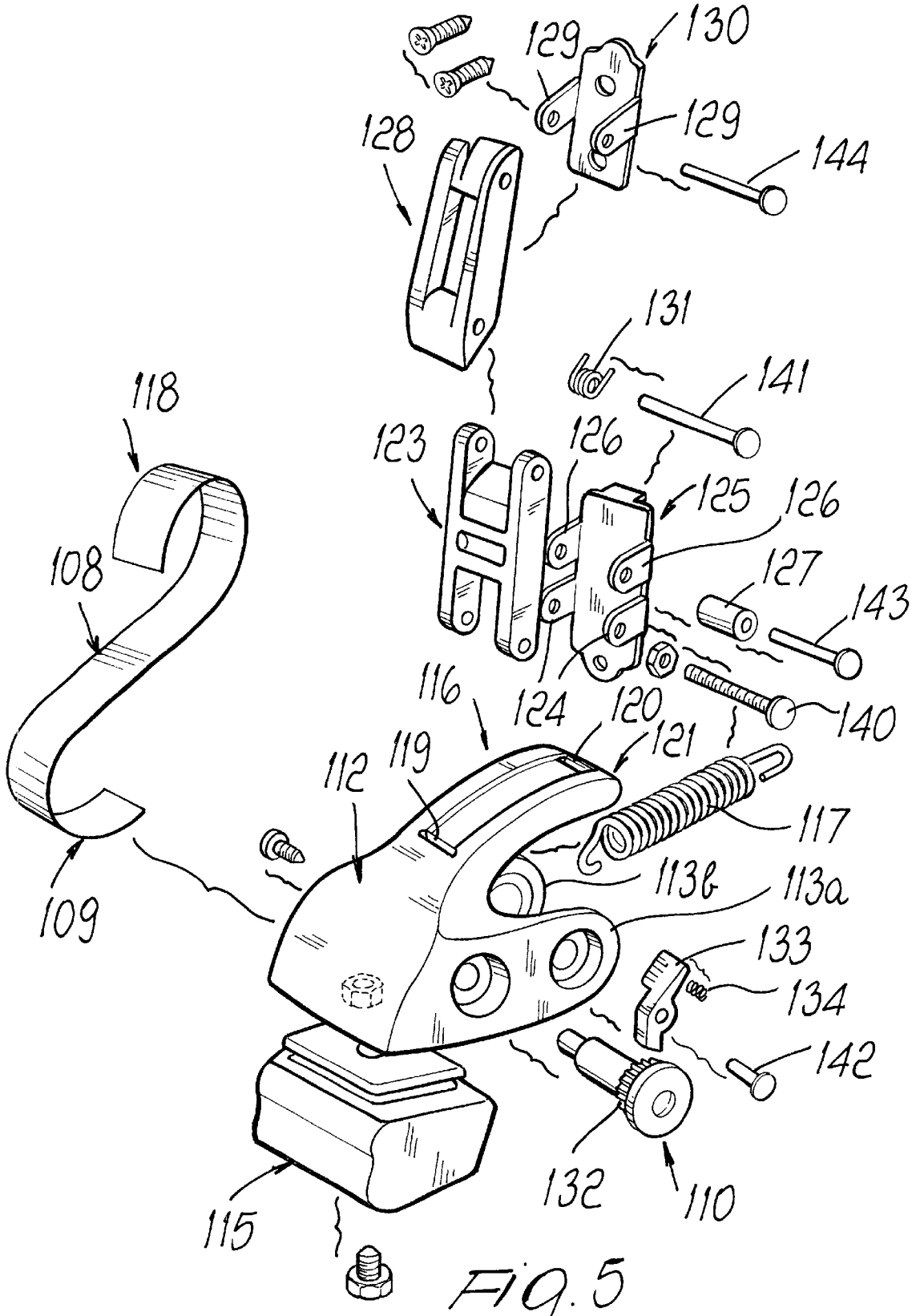
FIG. 5 is an exploded view of the braking device of FIG. 4.
Figure 6:
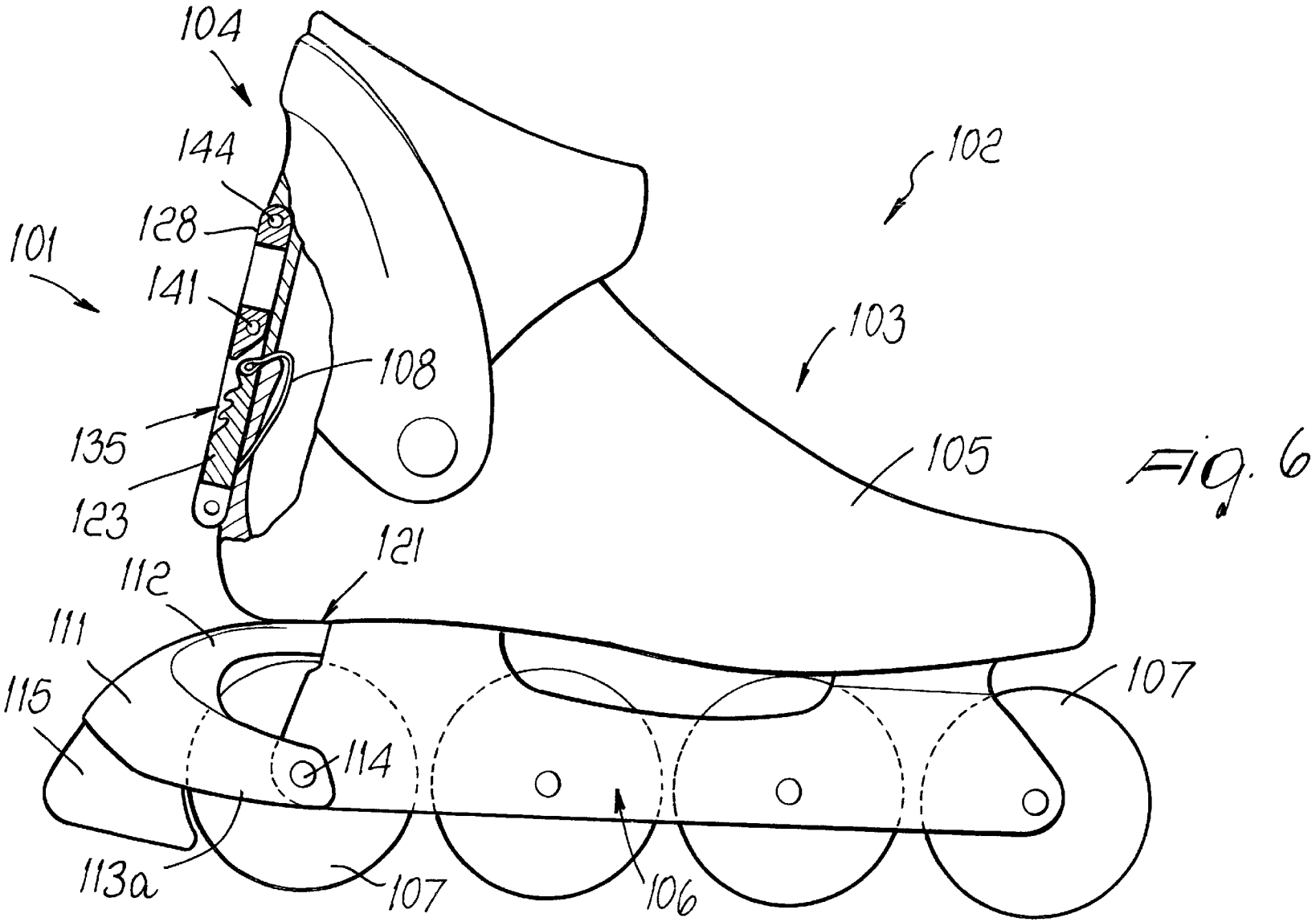
FIG. 6 is a partially sectioned side view of the braking device according to still a further aspect of the invention.

With reference to FIGS. 4–6, the reference numeral 101 designates the braking device, which is particularly usable for skates designated by the reference numeral 102.

Said skates comprise a shoe 103 composed of a quarter 104 which surrounds the lateral and rear region of the leg of the user and is articulated to a shell 105 below which a frame 106 is associated; said frame has a cross-section shaped like an inverted U and supports two or more wheels, designated by the reference numeral 107, which are optionally arranged mutually in-line.

Adapted conventional levers, not shown, are necessary for fastening the quarter 104 and the shell 105, and for a soft innerboot which is contained in the quarter 104 and/or the shell 105 and is also not shown since it is known to the expert in the field.

The braking device comprises at least one traction element, generally designated by the reference numeral 108, which is preferably constituted by a band or a cable.

Said traction element has a first end 109 which is associated with a braking element 111 which is constituted by a substantially C-shaped support 112 whose first wings 113*a* and 113*b* are advantageously pivoted at a second pivot 114 for the pivoting of the last wheel 107; a pad 115 is associated with said support 112 and interacts with a braking surface which is constituted for example by the ground or by one or more regions of one or more wheels; a tab 116 protrudes toward said frame and lies above the last wheel.

The braking element 111 is allowed to oscillate in contrast with a flexible element such as a first spring 117 which is rigidly coupled, at its ends, at the end of said tab and to the frame 106 or shell 105.

Advantageously, the first end 109 of the traction element is associated at a first adjustment pivot 110 which is rotatably associated at an adapted seat formed in the braking element 111; the first pivot 110 allows to adjust the useful length of the traction element 108.

The traction element 108 protrudes outside the tab 116 through a first slot 119 formed thereon; the band is then passed through a second slot 120 below the tab, then affects the tip 121 of the tab, and then affects the outer lateral surface of the shell; the band is then made to enter and exit the shell, preferably at third mutually adjacent openings 122*a* and 122*b* provided in a region which is proximate to the heel of the user.

As an alternative, exit from the shell can occur at the upper perimetric edge of said shell.

The traction element 108 also has a second end 118 which is associated with a third pivot 140 which is in turn rigidly coupled in a median region of a first lever or linkage 123, which is freely pivoted, at one end, to a pair of mutually parallel second wings 124 which protrude downwards from a first base 125 which is rigidly coupled to the rear of the shell 105; advantageously, said base has, in an upward region, a pair of third wings 126 between which a guiding roller 127 for the band 108 is freely rotatably associated by means of a sixth pivot 143; accordingly, there is no need to make said band enter and exit the shell.

The first lever 123 is articulated at its other end, by means of a fourth pivot 141, to the corresponding end of a second lever 128 which is in turn freely pivoted, at its other end, by means of a seventh pivot 144, to two fourth wings 129 which protrude from a second base 130 which is rigidly coupled to the rear of the quarter 104.

A second spring 131 is arranged coaxially to the fourth pivot 141 and is adapted to force the arrangement of the first and second levers or linkages adjacent to the shell 105.

As already noted, the braking device can also tension or adjust the length of the band by providing, on the head of the first adjustment pivot 110, a toothed ring 132 which interacts with a ratchet 133 which is pivoted outside the support 112 thanks to a fifth pivot 142; a third spring 134 forces the ratchet into contact with the toothed ring so as to prevent its rotation following a partial winding of the band on the first pivot 110; this adjustment is deactivated simply by acting on the end of the ratchet that does not interact with the toothed ring.

The use of the invention is as follows: during sports activity, and therefore if the quarter is tilted forwards, the traction element 108 is not subjected to any tensioning.

When instead the user tilts the quarter backwards beyond a preset angle, the first and second linkages tend to move away from the shell 105, accordingly moving, by means of the third pivot 140, also the second end 118 of the traction element 108 and applying tension thereto.

The braking pad 115 is thus forced into contact with the braking surface, for example the ground.

When it is no longer necessary to perform braking, the return of the quarter to an upright position places the first and second linkages adjacent to the shell 105 and the presence of the first spring 117 allows the movement of the pad 115 away from the braking surface, which in this embodiment is constituted by the ground.

It has thus been observed that the invention has achieved the intended aim and objects, a braking device having been provided which can be actuated by the user at a presettable angle of backward rotation of the quarter, at the same time considerably reducing, with respect to the cited prior art, the amount of energy dissipated due to friction; accordingly, the force that the user has to apply is smaller. Furthermore, the first and second linkages allows to take up, during the backward tilting of the quarter, a considerable useful amount of the band, improving braking efficiency. Finally, both actuation and deactivation of the braking element can be achieved very simply, allowing the user to assume a position which is adapted to control the braking action and therefore maintaining optimum balance and coordination in arm-leg movements. The braking device according to the invention is furthermore structurally simple and easy to industrialize and can also be easily applied to conventional skates. The braking device according to the, invention is susceptible of numerous modifications and variations, within the scope of the appended claims. Thus, for example, the working length of the band can be adjusted directly at the first lever or linkage 123 by providing it, as shown in FIG. 6, with a rack 135 to which the second end 118 of the band 108 can be selectively connected.

The materials and the dimensions that constitute the individual components of the braking device may of course be the most pertinent according to the specific requirements.

The disclosures in Italian Patent Application No. TV98A000167 and Italian Utility Model Application No. TV99U000016 from which this application claims priority are incorporated herein by reference.

What is claimed is:

1. A braking device for skates comprising a shoe composed of a quarter which is articulated to a shell associated with a supporting frame for two or more wheels, and comprising at least one flexible traction element which is connected at one end to a tab which protrudes from a braking element which is located in a region which is adjacent to a last wheel and oscillates in contrast with at least one flexible element, said at least one traction element being connected, at its other end, with at least one lever articulated to said shell, said at least one flexible traction element being adapted to be tensioned and taken up when said quarter oscillates backwards so as to tension and take up said flexible traction element to actuate said braking element, said at least one traction element comprises a band or a cable which has a first end which is associated with a braking element and a second end which is associated with a median region of a first lever which is freely pivoted, at one end, to two mutually parallel second wings which protrude downwards from a first base which is rigidly coupled to the rear of said shell, the corresponding end of a second lever being articulated to the other end of said first lever, said second lever being in turn freely slidingly associated, at its other end, at an adapted seat formed to the rear and axially with respect to said quarter.

2. The braking device according to claim 1, wherein when said quarter is tilted backwards beyond a preset angle, said traction element is subjected to a tension which is applied by said first and second levers, which move away from said shell, forcing a pad of said braking element into contact with said braking surface and making said second lever partially protrude from said seat formed in said quarter.

3. The braking device according to claim 2, wherein when it is no longer necessary to brake, the return of said quarter in an upright position moves said first and second levers adjacent to said shell and repositions said second lever in said seat.

4. The braking device according to claim 3, wherein the end part of said second lever is freely slideable within said seat, the depth and shape of said seat being the most appropriate according to the various stages that can occur during skating and being therefore such as to partially contain said second lever when said quarter reaches the maximum forward inclination and allow to avoid jamming once said quarter has been tilted backwards.

5. The braking device according to claim 4, wherein said seat has an abutment surface which presses on said second lever when said quarter oscillates backwards.

6. A braking device for skates comprising a shoe composed of a quarter which is articulated to a shell associated with a supporting frame for two or more wheels, and comprising at least one flexible traction element which is connected at one end to a tab which protrudes from a braking element which is located in a region which is adjacent to a last wheel and oscillates in contrast with at least one flexible element, said at least one traction element being connected, at its other end, with at least one lever articulated to said shell, said at least one flexible traction element being adapted to be tensioned and taken up when said quarter oscillates backwards so as to tension and take up said flexible traction element to actuate said braking element, said at least one traction element is constituted by a band or a cable which has a first end which is associated with a braking element constituted by a substantially C-shaped support whose first wings are advantageously pivoted at a wheel pivot for the pivoting of the last wheel, a pad being associated with said support and interacting with a braking surface, a tab protruding toward said frame and lying above the last wheel, said braking element being allowed to oscillate in contrast with a flexible element which is rigidly coupled, at its ends, at the end of said tab and to said frame or shell.

7. The braking device according to claim 6, wherein said traction element protrudes externally and reenters said tab through a first slot and a second slot, then affects the tip of said tab, and then affects the outer lateral surface of said shell, said traction element being then made to enter and exit said shell and being associated, at the second end, with a median region of a first lever.

8. The braking device according to claim 7, wherein said first lever is freely pivoted, at one end, to two second mutually parallel wings which protrude from a first base which is rigidly coupled to the rear of said shell, said base advantageously having, in an upward region, two third wings between which a guiding roller for said traction element is freely rotatably associated.

9. The braking device according to claim 8, wherein the corresponding end of a second lever is articulated to the other end of said first lever, said second lever being in turn pivoted freely at its other end to two fourth wings which protrude from a second base which is rigidly coupled to the rear of said quarter.

10. The braking device according to claim 9, wherein a second spring is arranged to force the arrangement of said first and second levers adjacent to said shell.

11. The braking device according to claim 10, wherein said first end of said first traction element is associated at a first adjustment pivot which is rotatably associated at an adapted seat formed in said braking element, and comprising a means which is adapted to tension or adjust the length of said traction element, said means being constituted by a toothed ring which is provided on the head of said first adjustment pivot, one end of a ratchet interacting with said toothed ring, said ratchet being pivoted outside said support, a third spring forcing said ratchet into contact with said toothed ring so as to prevent its rotation following a partial winding of said traction element on said first adjustment pivot.

12. The braking device according to claim 11, wherein when said quarter is tilted backwards beyond a preset angle, said traction element is subjected to a tension applied by said first and second linkages which move away from said shell, forcing said pad into contact with said braking surface.

13. The braking device according to claim 12, wherein a rack is associated with said first lever, said second end of said traction element being meant to be selectively connected to said rack.

* * * * *